US007028859B2

(12) United States Patent
Moon et al.

(10) Patent No.: US 7,028,859 B2
(45) Date of Patent: Apr. 18, 2006

(54) DECK STORAGE BOX

(75) Inventors: Brian Moon, Batavia, IL (US); Jed Richardson, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 108 days.

(21) Appl. No.: 10/409,676

(22) Filed: Apr. 8, 2003

(65) Prior Publication Data

US 2004/0200832 A1 Oct. 14, 2004

(51) Int. Cl.
*B65D 6/24* (2006.01)

(52) U.S. Cl. ..... 220/4.28; 297/118; 297/440.1

(58) Field of Classification Search ..... 220/4.28–4.33; 297/1, 118, 440.1, 440.14
See application file for complete search history.

(56) References Cited

U.S. PATENT DOCUMENTS 4,662,515 A * 5/1987 Newby, Sr. ..... 206/349
4,782,972 A * 11/1988 Wenkman et al. ..... 220/4.28
4,809,851 A * 3/1989 Oestreich et al. ..... 206/599
4,917,256 A * 4/1990 Kruck et al. ..... 220/4.28
D308,486 S 6/1990 Willson
D308,487 S 6/1990 Willson
D309,106 S 7/1990 Willson
5,161,709 A * 11/1992 Oestreich, Jr. ..... 220/6
5,368,380 A * 11/1994 Mottmiller et al. ..... 312/263
5,704,508 A * 1/1998 Keip et al. ..... 220/4.31
5,816,425 A * 10/1998 Keip et al. ..... 220/4.31
5,979,352 A 11/1999 Pearcy et al.
D421,181 S * 2/2000 Tisbo et al. ..... D3/273
6,050,291 A * 4/2000 Whitehead et al. .... 137/355.26
D444,626 S * 7/2001 Anderson et al. ..... D3/273
D483,190 S * 12/2003 Richardson ..... D6/336

* cited by examiner

*Primary Examiner*—Jes F. Pascua
(74) *Attorney, Agent, or Firm*—McHale & Slavin, P.A.

(57) ABSTRACT

The present invention relates to kit for a deck storage box utilizing injection molded plastic panels capable of being packaged and shipped in a knocked-down state and constructed into a secure enclosure. The storage device is also constructed to allow interchangeable covers, allowing a number of enclosures to be configured using common components.

19 Claims, 11 Drawing Sheets

DECK STORAGE BOX

FIELD OF THE INVENTION

This invention relates generally to a deck storage device constructed of plastic structural panels. More specifically, the present invention relates to a deck storage box utilizing injection molded plastic panels capable of being packaged and shipped in a knocked-down state and constructed into a secure deck storage enclosure.

BACKGROUND INFORMATION

Devices for storing household items such as gardening tools, children's toys, barbeque accessories and the like are well known. Permanent structures such as utility sheds or garages are often utilized for storage of such items. In recent years patios and decks have become a common addition to homes and apartments alike and while patios and decks provide outdoor recreational space for families they often consume a great deal of the lawn space available to the homeowner. Lawn space consumed by decks and patios is no longer available to the homeowner for storage sheds or permanent structures. Requiring the homeowner to find alternative storage space for items normally stored in the utility shed.

Devices for storing marine related articles at the water side are also well known. Permanent structures such as boat houses are often used for storage of boats and other equipment. It can be appreciated that on beaches and waterfront property, there are often many types of water toys and recreational equipment such as life-jackets, fishing gear and other articles that may be utilized in the water and which require storage. If there is no storage available at the water side, the equipment must be carried back and forth between storage space remote from the waterfront or placed in a boat which typically does not have adequate storage space and which does not provide adequate security.

Although permanent structures such as boathouses or utility sheds may provide adequate storage, such structures have several drawbacks. The permanent structures may be very costly to build and maintain. In addition to the cost, the permanent structure may require a permit to build and occupy space on the property or along the beach.

In addition to permanent storage sheds or boat houses, the prior art has proposed a number of different panel systems, or kits comprising blow molded or extruded panels and connector members for forming a wide variety of structures. Due to manufacturing limitations blow molded and extruded plastic components cannot be formed with the integral cross-bracing ribs or the intricate shapes and sharp corners required for integrated connectors that are possible with injection molding. Typically, such systems require extruded metal or plastic connector members having a specific cross-sectional geometry that facilitate an engagement between such members and one or more plastic panels having a complimentary edge configuration.

A particularly common structure for the connector members is the I-beam cross section. The I-beam defines free edge portions of the connector member which fit within appropriately dimensioned and located slots in the panel members. U.S. Pat. No. 5,979,352 teaches a storage box that is representative of the state of the art I-beam connector members. The I-beam sides of the connectors engage with the peripheral edge channels of a respective wall panel and thereby serve to join such panels together at right angles. Straight or in-line versions of the connector members are also included in the kits to join panels in a coplanar relationship to create walls of varying length.

The prior art has also suggested a number of smaller one piece plastic containers with removable lids for storage use. U.S. Pat. Nos. D308,486, D308,487, D309,106 teach such one piece containers. Typically such containers provide portability for storage but lack capacity to store larger items. Moreover, because these devices do not break down they are difficult to ship from the manufacturer to the consumer.

Such prior art systems, while working well, have not met all of the needs of manufacturers to provide a product that can be easily manufactured, packaged and shipped or the needs of consumers requiring structural integrity combined with modularity and aesthetic appearance.

Paramount among such needs is a panel system which creates deck storage box walls which resist panel separation, buckling, racking and weather infiltration. Security is a further consideration, the box formed by the panels must tie into the cover and bottom in such a way as to unify the entire enclosure.

Also, from a versatility standpoint, a cover should be present which can be easily interchanged after assembly of the side and bottom components and which provides additional seating as well as dependable security and pivoting access to the contents of the deck box.

There are also commercial considerations that must be satisfied by any viable deck box system or kit; considerations which are not entirely satisfied by state of the art products. The deck storage box must be formed of relatively few component parts that are inexpensive to manufacture by conventional techniques. The deck storage box must also be capable of being packaged and shipped in a knocked-down state. In addition, the system must be modular and facilitate the creation of a family of enclosures that vary in appearance and functionality but which share common, interchangeable components.

Finally, there are ergonomic needs that an enclosure system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting deck storage box or otherwise detract from the internal storage volume of the resulting deck storage box or otherwise negatively affect the utility of the deck storage box.

BRIEF DESCRIPTION OF THE INVENTION

The present invention provides a system, or kit, of injection molded panels having integrated connectors which combine to form a deck storage box. The panels are formed of injection molded plastic to interlock with one another without the need for separate fasteners or I-beam connectors. The system incorporates a minimum number of components to construct a deck storage box by integrally forming the connectors into the injection molded panels. This minimizes the need for separate extruded or molded connectors to assemble the storage box. The integrated connection of the side wall, cover and bottom panel components also simplifies storage box construction. Injection molding allows the panels to be formed with integral cross-bracing, ribs and gussets for increased rigidity when compared to blow molded or extruded panels. The same side wall and bottom panel components are used to create a variety of storage boxes and the assembly of the storage boxes require minimal hardware and a minimum number of hand tools.

The front and rear wall panels have outwardly projecting locking posts for interlocking cooperative engagement with sockets in the bottom panel. The left and right side wall panels are constructed with outwardly extending contoured locking posts for interlocking cooperative engagement with sockets in the ends of the front and rear panels. The engagement between the locking posts and the sockets serve to rigidly connect the components together. The system further includes a cover which slides into place after the front, rear, side and bottom panels have been fully assembled. The system is constructed to allow various cover panels to be utilized further increasing the utility of the storage box.

Accordingly, it is an objective of the present invention to provide a modular deck storage box system having integrated connectors for creating various storage boxes using common components.

A further objective is, to provide a modular panel storage box system with integrated connectors which accommodates injection molding plastic formation of the panel components for increased structural integrity.

Yet a further objective is to provide a modular panel storage box system in which the side walls, cover, and bottom panel are integrally interlocked without I-beam connectors or fasteners.

Another objective is to provide an deck storage box constructed of modular panels having a cover assembly which allows interchangeability after all other parts are assembled.

Yet another objective is to provide a kit for a deck storage box that is capable of being packaged and shipped in a knocked-down state and constructed into a secure enclosure.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
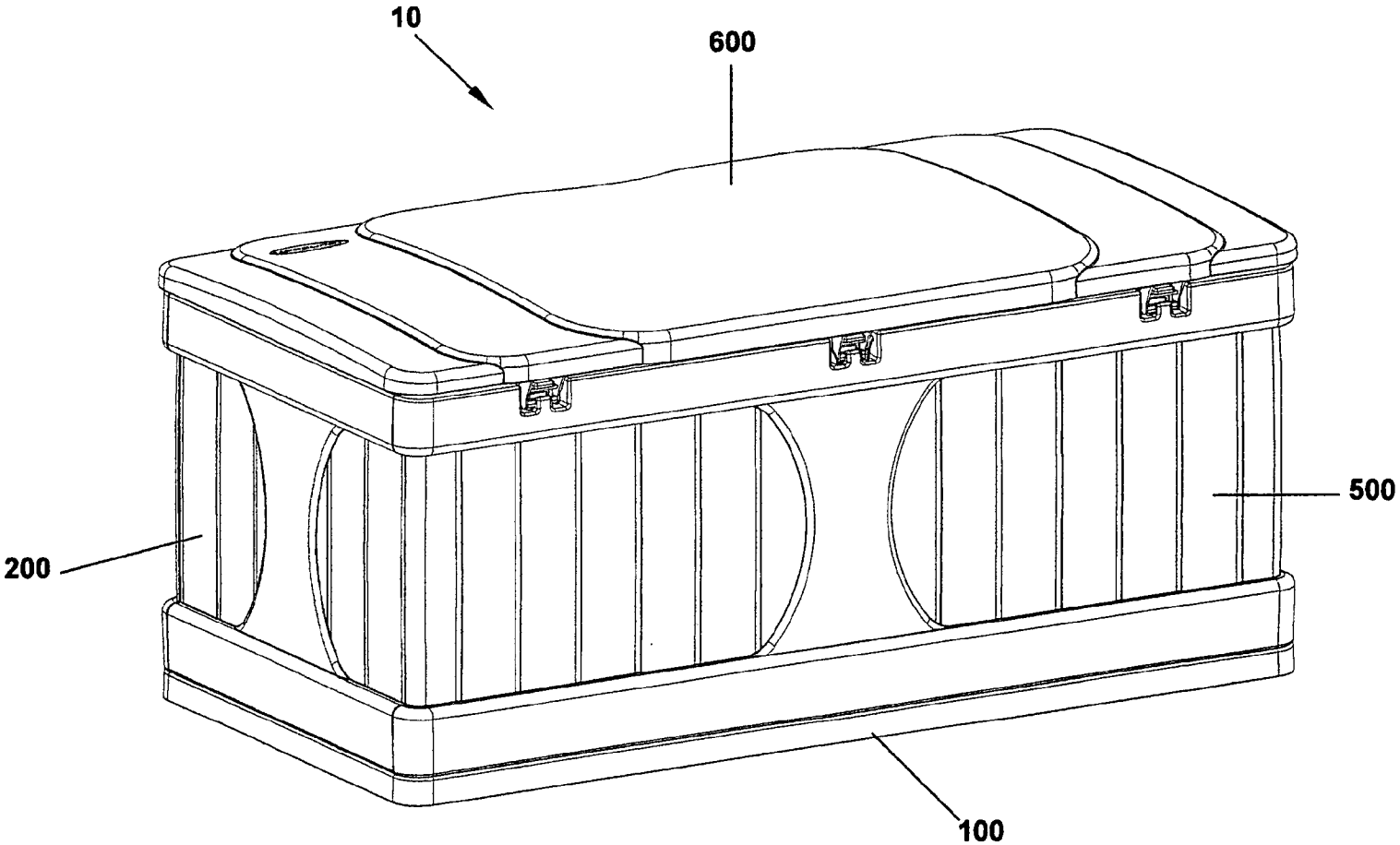
FIG. 1 is a perspective view of one embodiment of the instant invention.
Figure 2:
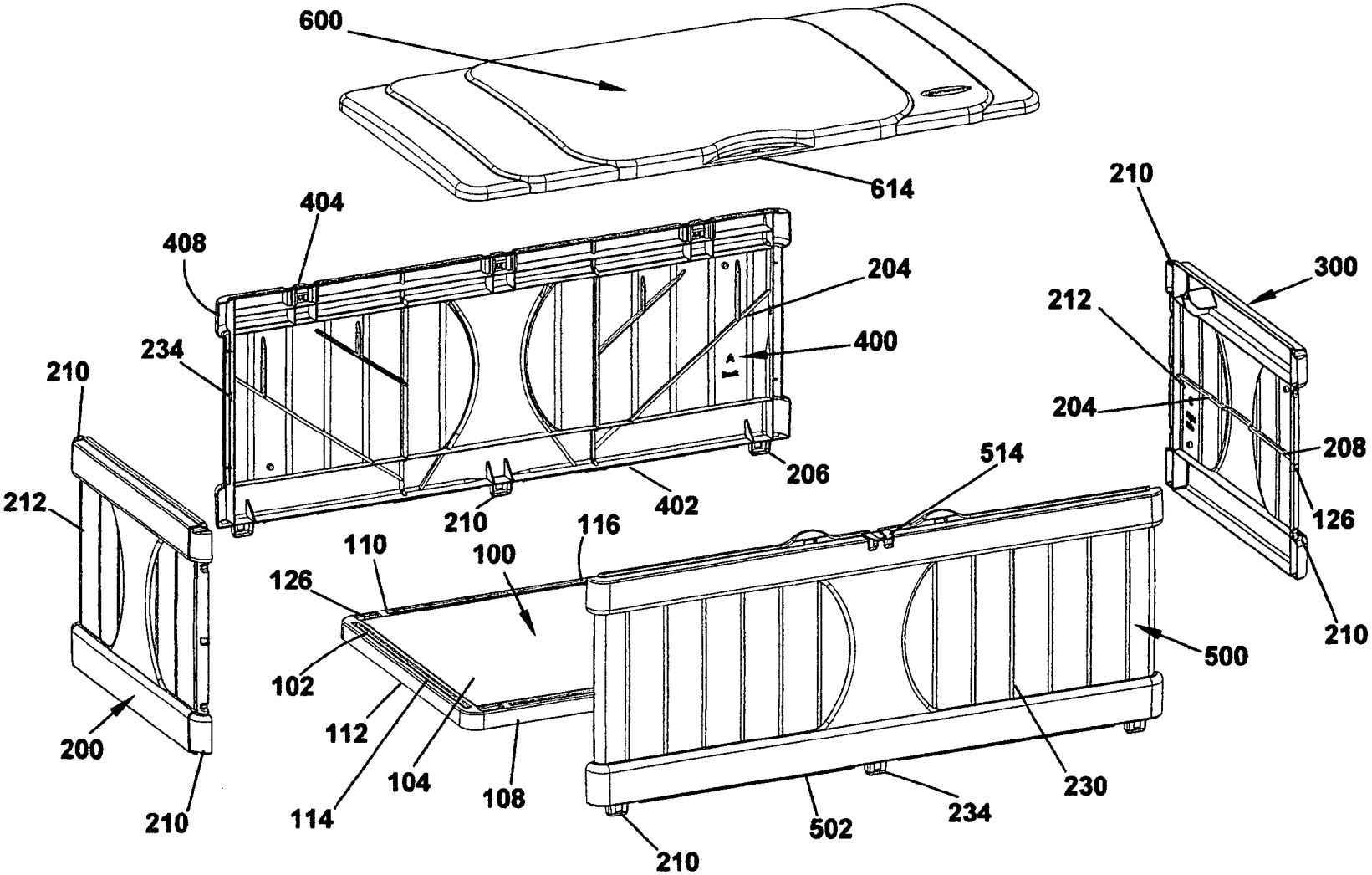
FIG. 2 is an exploded view of the deck box enclosure shown in FIG. 1.
Figure 3:
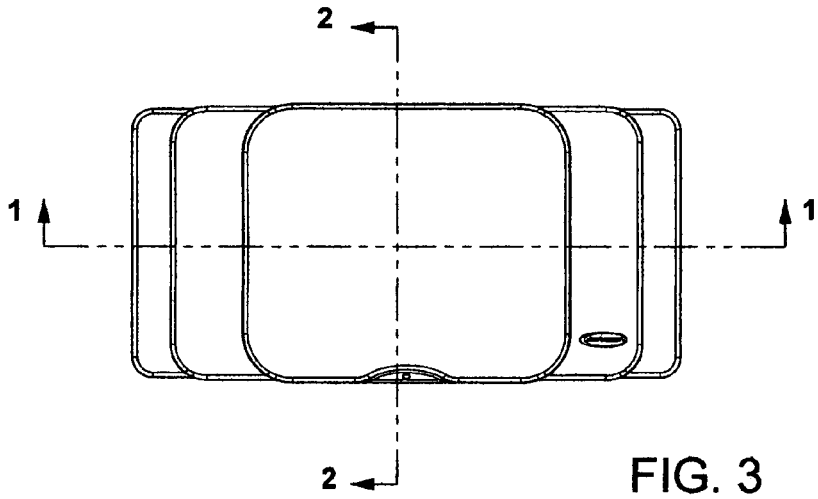
FIG. 3 is a top view of the deck box embodiment shown in FIG. 1.
Figure 4:
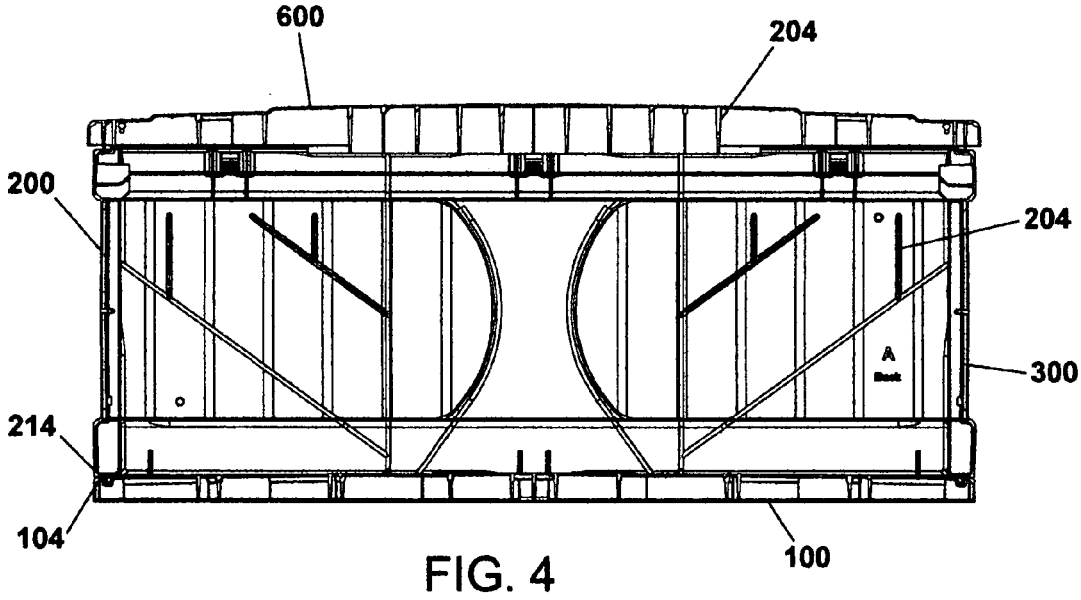
FIG. 4 is a section view along lines 1—1 of the deck box embodiment shown in FIG. 3 illustrating the structural ribs integrally formed into the panels.
Figure 5:
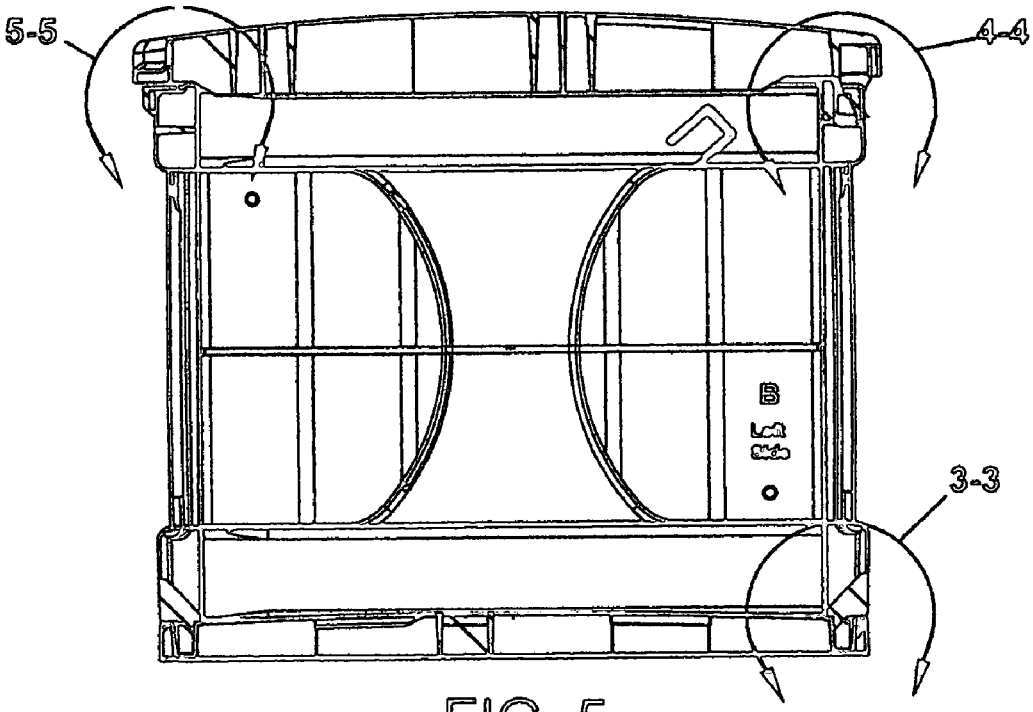
FIG. 5 is a section view along lines 2—2 of the deck box embodiment shown in FIG. 3 illustrating the cooperative engagement of the panels.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

FIGS. 1–5 which are now referenced illustrate perspective, exploded and sectioned views of the deck box enclosure, generally referenced as 10, according to a preferred embodiment of the present invention. The enclosure is made up of a floor panel 100, left side wall panel 200, right side wall panel 300, rear wall panel 400, front wall panel 500 and cover panel 600. In the preferred embodiment, the panels comprising the assembly are formed of but not limited to a suitable plastic such as polystyrene or polyethylene, through the process of injection molding. The result is that the panels comprising the deck box enclosure 10 are formed as single-walled panels with integral connectors, and cross bracing. Strengthening ribs 202 and gussets 204 are formed within the inner surfaces of the wall panels 200–300 in order to enhance rigidity of the panels while leaving the external surface in a generally smooth condition for aesthetic purposes, as shown in FIG. 1. The floor panel 100 has a top surface 104, bottom surface 106, like-constructed front and rear edges 108 and 110, and like-constructed left and right edges 112 and 114. Adjacent to each of the front and rear edges 108, 110 is a means of attaching the floor panel to the front and rear wall panels 400, 500 illustrated as a plurality of formed sockets 116 extending downwardly from the top surface 104. The formed sockets 116 are constructed and arranged to cooperate with locking posts 210 extending outwardly along the bottom edges 402, 502 of the front and rear wall panels 400, 500. The locking posts 210 and sockets 116 are constructed and arranged so that the locking posts 210 enter and mateably engage the sockets 116 securing the panels together in an inter-fitting engagement with their respective top surfaces in a perpendicular arrangement. The top surface of the bottom panel is also constructed with a plurality of grooves 102 extending around the perimeter of the top surface 104. The grooves 102 are constructed and arranged to cooperate with tongues 214 (FIG. 4) extending downward from the bottom surfaces of the front, back, and side panels. The tongue 214 and groove 102 arrangement increases the structural integrity of the deck box 10 by preventing the panels 200, 300, 400, 500 from bowing or bending inwardly or outwardly, and thus, adversely affecting the appearance or operation of the deck box 10.

The left and right side wall panels 200 and 300 are each configured having a first end 208 and a second end 212. Both ends 208, 212 include an integrally formed attachment means illustrated as an elongated contoured attachment post 210. The attachment posts 210 are generally constructed and arranged to cooperate with the contoured sockets 408 provided in either end of the front 400 and rear panels 500.

The outer surface of the panels 200, 300, 400, 500 are constructed generally smooth having a plurality of inwardly bowed grooves 230 for added strength and aesthetic appearance. The inside of the panels 200, 300, 400, 500 are constructed with a plurality of strengthening ribs 204 extending across the panels with a portion of the ribs 204 (FIG. 4) being provided with a plurality of gussets 206 to further strengthen the panels. The ribs 204 and gussets 206 increase the structural integrity of the deck box 10 by preventing the panels 200, 300, 400, 500 from bowing or bending inwardly or outwardly, and thus, adversely affecting the appearance or operation of the deck box 10. The integrally formed ribs 204 and gussets 206 are facilitated by injection molding. Injection molding offers significant strength and stability advantages over blow-molding or extrusion as utilized in the prior art. In this manner the enclosure of the instant invention is capable of handling a significant amount of weight as compared to blow molded or extruded deck boxes.

The left and right side panels 200, 300 are attached to the front and rear panels 400, 500 by inserting the contoured locking posts 210 into contoured sockets 408 until the spring tabs 126 integrally formed into the contoured locking posts 210 engage the apertures 234 in the sockets 408 of the front and rear panels 400, 500. It will be appreciated that the purpose of the contoured elongated locking posts 210 are to align two panels in a perpendicular relationship and to facilitate their mechanical connection. The perpendicular panels are brought into an overlapping relationship wherein the contoured locking posts 210 enter the corresponding cavity 408 in the front and rear panels 400, 500. The result is a mechanically secure connection between the two panels. The overlapping edges between the panels as described above provides a secure connection and offers several advantages. First, the design allows the panels to be connected without the need for separate connectors. Second, the design creates a positive lock that prevents separation of the panels. Third, the design maintains alignment of the panels in the same plane and prevents bowing or bending of either panel relative to one another. The resultant deck box created by the combination of the interlocking panels benefits from high structural integrity and reliable operation.

Figure 6:
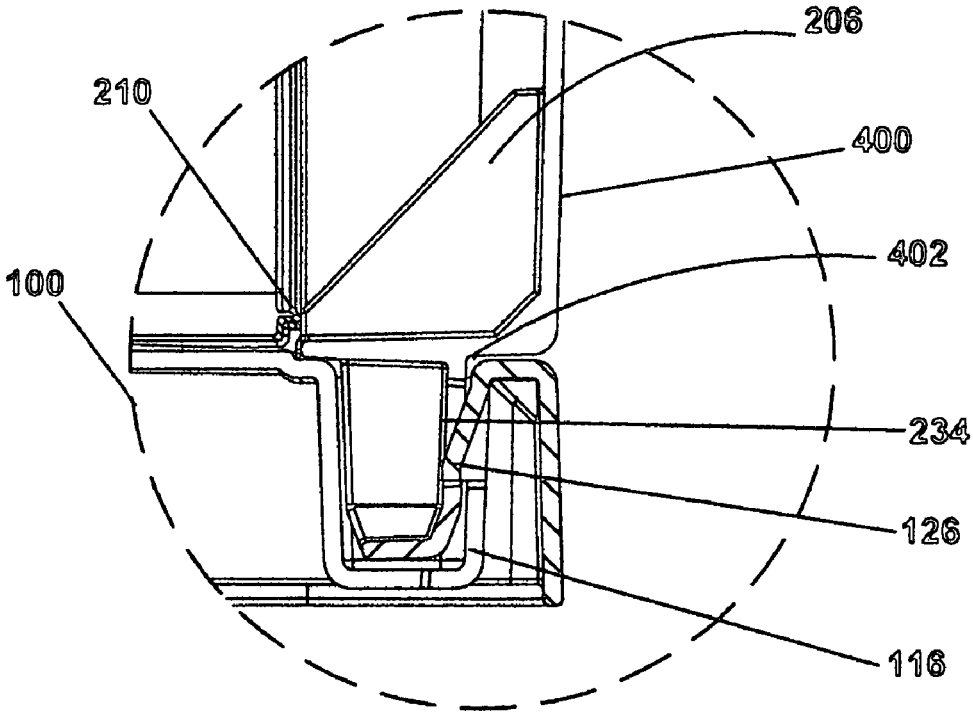
FIG. 6 is a partial section view along lines 3—3 of the deck box embodiment shown in FIG. 5 illustrating the cooperative engagement of the locking posts and the bottom panel.

Referring to FIG. 6, the front and rear panels 400, 500 are attached to the floor panel 100 by sliding the locking posts 210 along the bottom edges 402, 502 into the corresponding sockets 116. The sockets 116 in the bottom panel 100 correspond in shape and size to that of the locking posts 210 and spring tabs 126 integrally formed into the sockets 116 align with apertures 234 in the locking posts 210 to engage the front and rear panels 400 and 500. The result is a positive mechanical connection between the front and rear panels 400, 500, and the floor panel 100.

Figure 7:
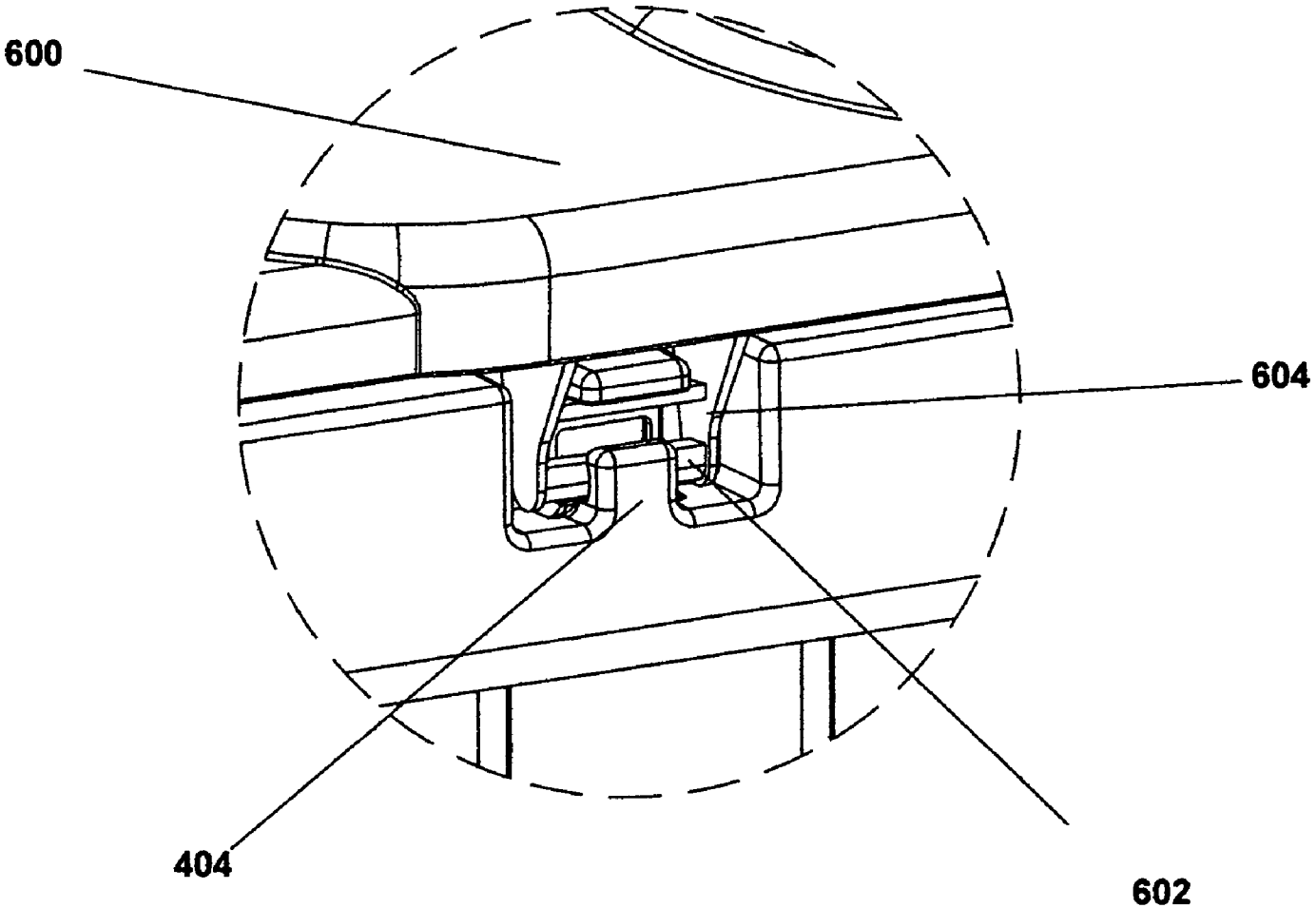
FIG. 7 is partial perspective view illustrating the cooperative engagement between the hinge pin receiver and the hinge pin.
Figure 8:
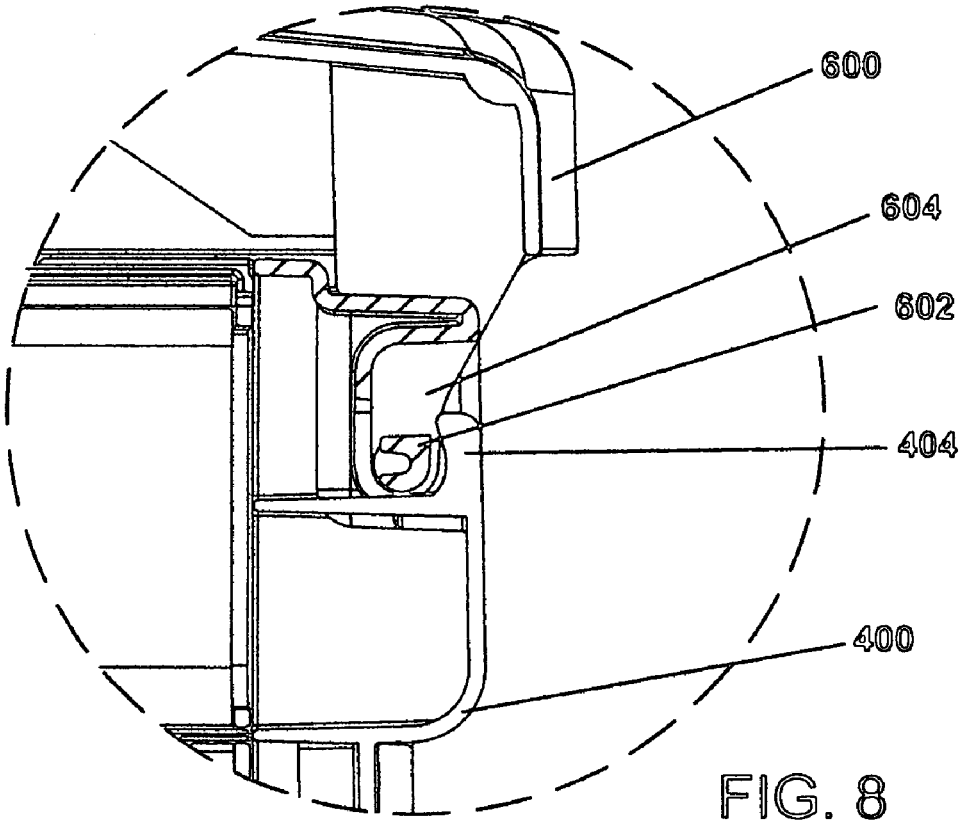
FIG. 8 is a partial section view along lines 4—4 of the deck box embodiment shown in FIG. 5 illustrating the cooperative engagement of the cover hinge pins and the rear panel.
Figure 9:
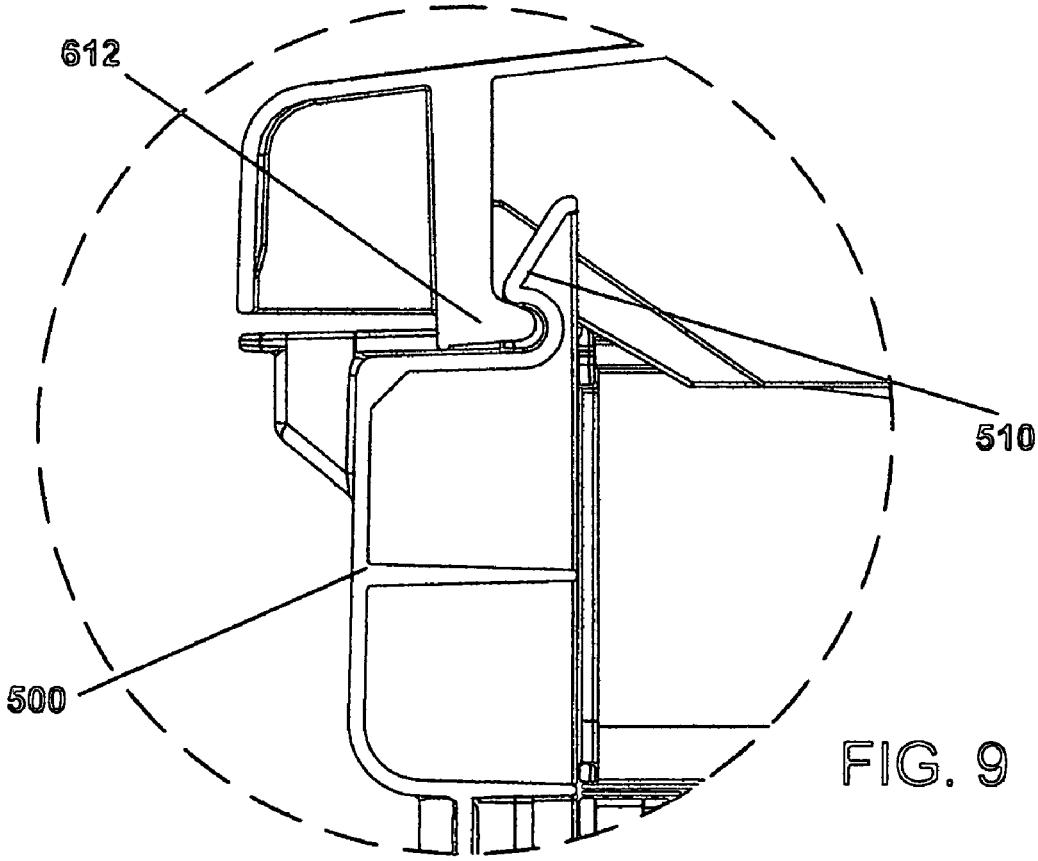
FIG. 9 is a partial section view along lines 5—5 of the deck box embodiment shown in FIG. 5 illustrating the cover latch of the instant invention.

Referring to FIGS. 7–9, partial perspsective and section views of the deck box illustrating one of the hinge means illustrated herein as a separable hinge assembly. The hinge assemblies generally include a plurality of hinge pins 602 and a plurality of cooperating hinge pin receivers 404. The hinge pin receivers 404 are integrally formed into the top outer portion of the rear panel 400 and are constructed and arranged to cooperate with a cover hinge pin 602 to allow rotational movement of the cover 600. The hinge pins 602 are each supported by a pair of downwardly depending supports 604 located adjacent to the rear edge 110 of the cover 600. The hinge pins 602 cooperate with their respective hinge pin receivers 404 to allow rotational movement of the cover 600 and also allow the cover 600 to be removed when in the open position by lifting the cover upward and sliding the pins 602 outward from the hinge pin receiver 404.

Figure 10:
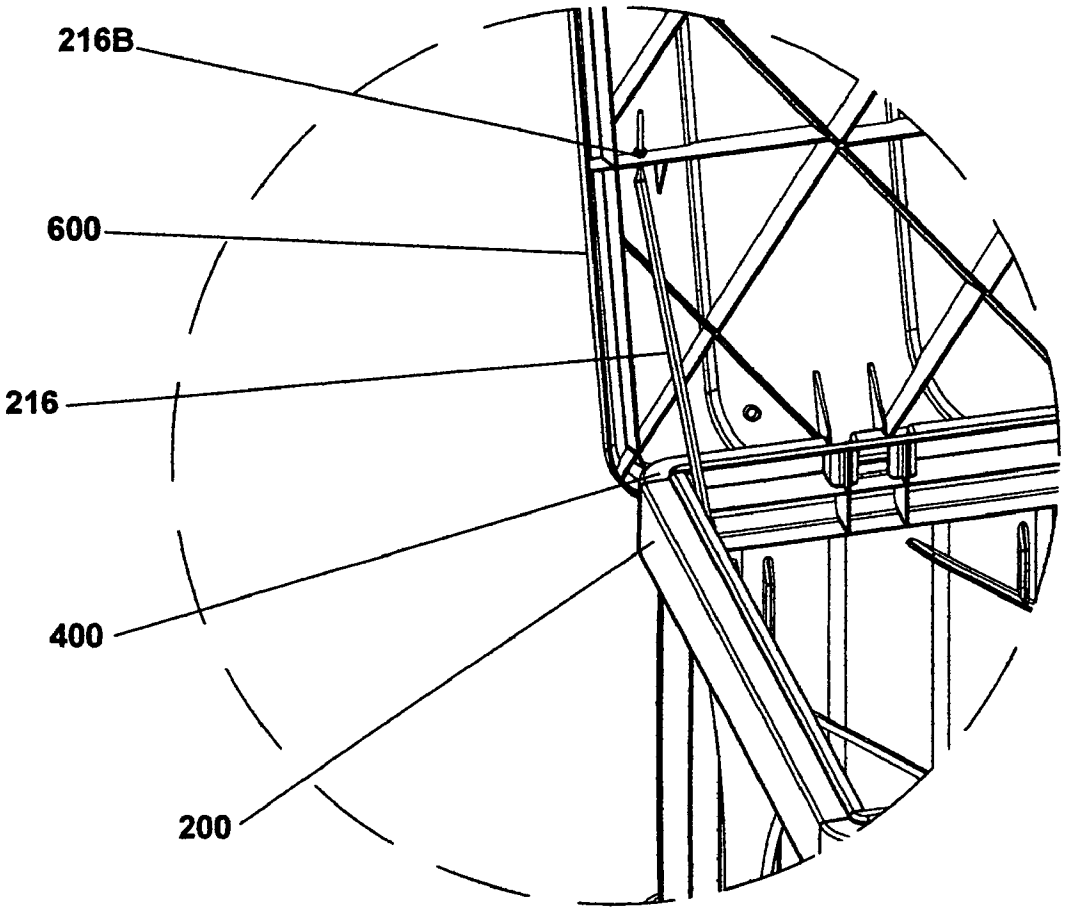
FIG. 10 is a partial perspective view illustrating the support strap of the instant invention.
Figure 11:
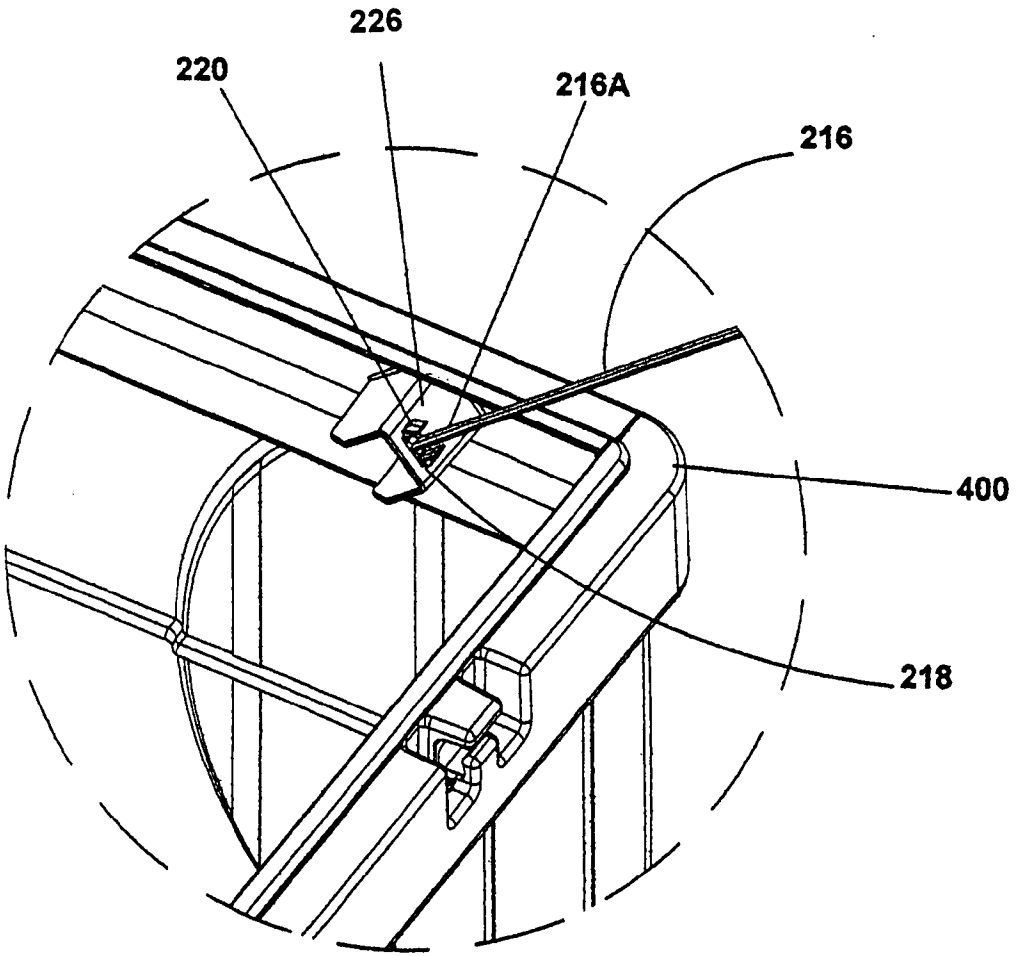
FIG. 11 is a partial perspective view illustrating the cooperative engagement between the side panel and the support strap of the instant invention.
Figure 12:
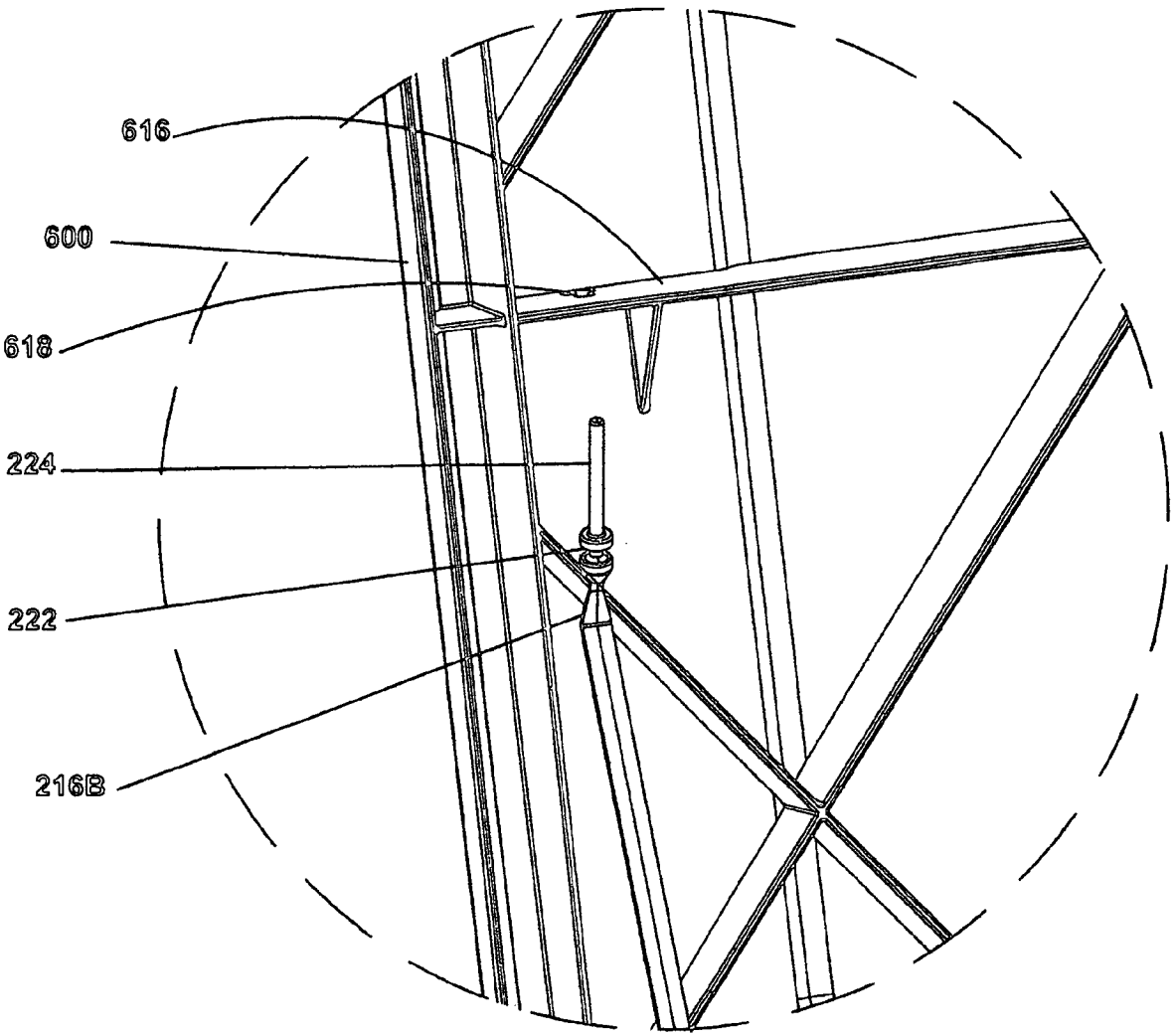
FIG. 12 is a partial perspective view illustrating the cooperative engagement between the cover panel and the support strap of the instant invention.

Referring to FIGS. 10–12, the removable and replaceable support strap is illustrated in cooperation with a side panel and the cover. The support strap(s) 216 are constructed from a flexible material, e.g. nylon, and arranged to provide support for the cover 600, 610 while it is in the open position. The flexibility of the support strap allows the cover to be easily closed without the need to disconnect the strap. The support strap 216 is constructed with a first end 216A which is removably attachable to one of the side panels 200 via integral spring tabs 220 and a second end 216B which is removably attachable to the cover 600, 610 via snap groove 222. The side panels 200 and 300 are constructed with an integrally formed U-shaped strap mount 226 having an aperture 218 for receiving the first end 216A of the support strap. The cover 600, 610 is constructed with an integrally formed tab 616 having an aperture 618 for receiving the second end 216B of the strap 216. The support strap 216 is easily attached to the side panel strap mount 226 and the cover 600, 610 by sliding the second end 216B of the support strap 216 through apertures 218 and 618 and thereafter snapping spring tabs 220 into place and sliding the snap groove 222 into place using the stem 224. The snap in and snap out arrangement allows the support strap to be easily attached or unattached from the cover and/or side panel without the need for tools.

It should be appreciated that the hinge and cover strap assemblies allow the cover to be installed and/or removed when the cover 600 or 610 is in the open position and yet the cover is secure and non-removable when in the closed position.

Figure 13:
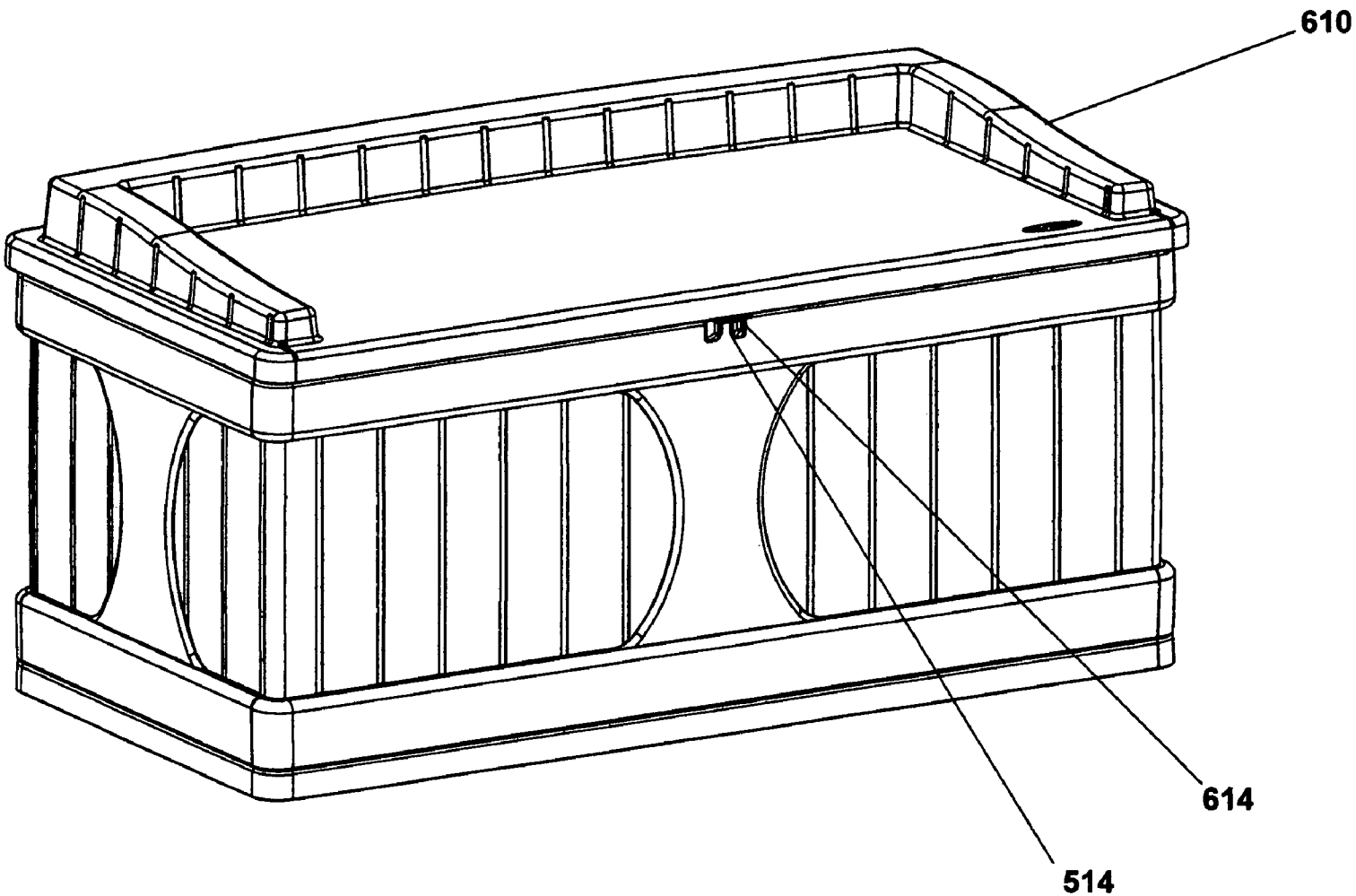
FIG. 13 is a perspective view illustrating an alternative embodiment of the instant invention.
Figure 14:
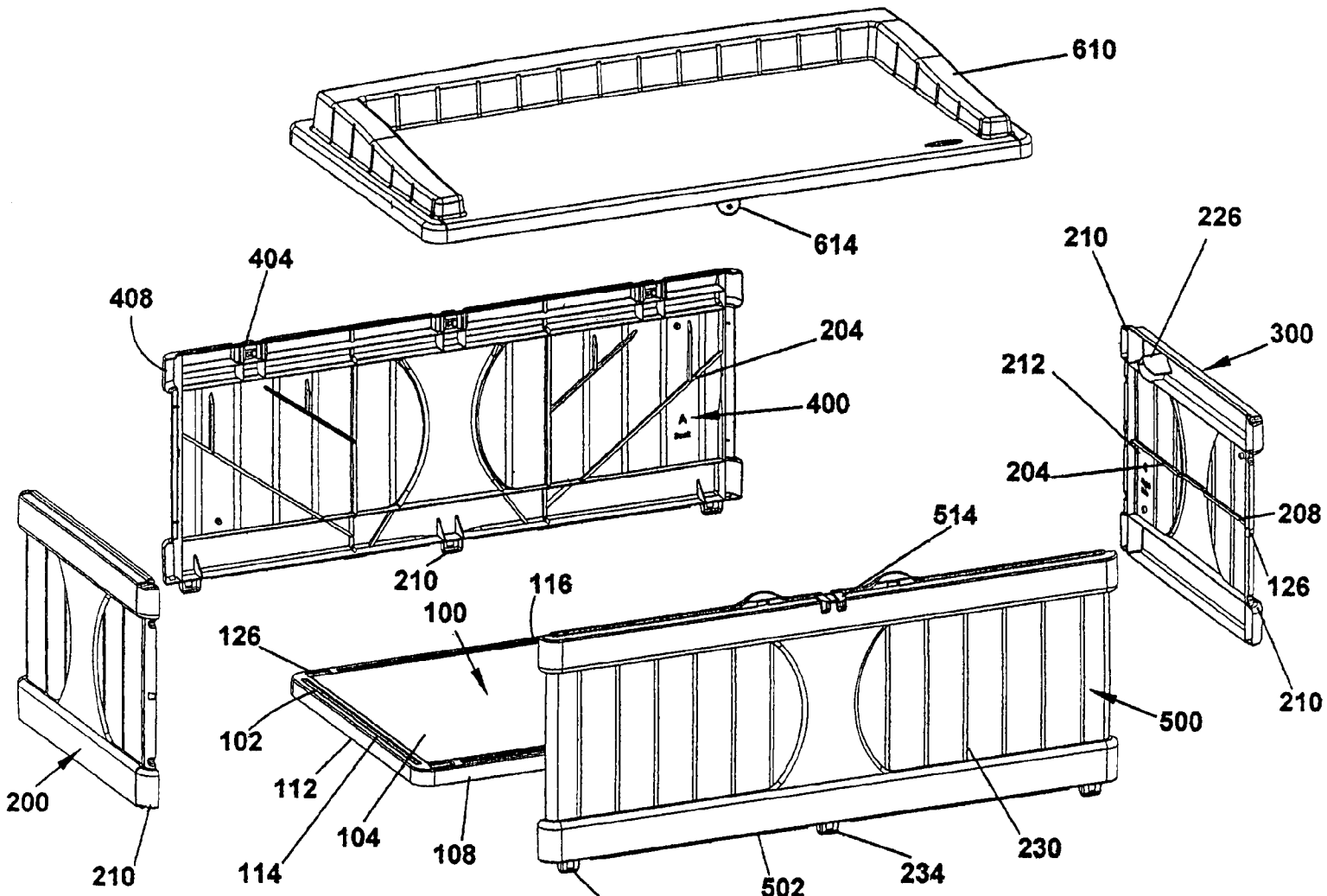
FIG. 14 is an exploded view of the deck box enclosure shown in FIG. 10.

Referring to FIGS. 13–14, an alternative embodiment of the present invention is shown wherein the deck box can be utilized as a bench seat by changing the cover 610. In this manner the same construction can be utilized to build different deck boxes utilizing substantially the same components. Reinstallation or changing the cover to a bench seat cover 610 merely requires the hinge pins 602 to be lined up with the corresponding hinge pin receivers 404 in the rear panel 400 and slid in and downward into the receivers 404. The cover 610 is secured in place by pivoting the cover downward until the spring latch 510 (FIG. 9) integrally formed into the front panel 500 engage corresponding catches 612 formed in the depending front portion of the cover 610. The result is a positive mechanical connection between the side panels 200, front and rear panels 300 and the cover. The cover can be further secured by inserting a lock through the apertures 614 and 514 provided in the cover 600,610 and the front panel 500.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A deck storage box kit comprising:

a single-walled left side panel for enclosing the left side of said deck storage box;

a single-walled right side panel for enclosing the right side of said deck storage box;

a single-walled rear panel for enclosing the back of said deck storage box;

a single-walled front panel for enclosing the front of said deck storage box;

a single-walled cover for enclosing the top of said deck storage box, said top cover constructed and arranged to provide ingress into and egress from said deck storage box;

a single-walled bottom panel for enclosing the bottom of said deck storage box, said bottom panel comprising a top surface, a bottom surface and four closed edges;

said bottom surface of said bottom panel is constructed and arranged to provide rigidity and stability to said deck storage box;

said top surface of said bottom panel having a means of attaching to said rear panel and said front panel, said means of attaching includes a plurality of locking sockets arranged in a linear fashion adjacent to the front and rear closed edges and extending downwardly from said top surface to secure said front and rear panels to said bottom panel and a plurality of grooves extending substantially around the perimeter of said top surface adjacent to said closed edges, wherein said plurality of grooves cooperate with the bottom edge of said left side panel, said right side panel, said rear panel and said front panel;

wherein said left panel includes a bottom edge having an outwardly extending tongue constructed and arranged to cooperate with said groove in said bottom panel, a first end having an attachment means constructed and arranged to cooperate with a rear panel in a perpendicular relationship, a second end having an attachment means constructed and arranged to cooperate with a front panel in a perpendicular relationship;

wherein said deck storage box can be shipped in a disassembled state and assembled on a desired site.

2. The deck storage box kit of claim 1 wherein said bottom surface of said floor panel includes integrally formed cross-bracing;

wherein said cross-bracing provides increased weight capacity and stability to said deck storage box.

3. The deck storage box kit of claim 1 wherein said first end attachment means includes at least one integrally formed elongated contoured interlock post and said second end attachment means includes at least one integrally formed elongated contoured interlock post;

wherein said first elongated contoured interlock post is brought into an overlapping relationship with a corresponding elongated contoured interlock socket in said rear panel and said second elongated contoured interlock post is brought into an overlapping relationship with a corresponding elongated interlock socket in said front panel resulting in a mechanically secure connection between said left, front and rear panels.

4. A deck storage box kit comprising:

a single-walled left side panel for enclosing the left side of said deck storage box;

a single-walled right side panel for enclosing the right side of said deck storage box;

a single-walled rear panel for enclosing the back of said deck storage box;

a single-walled front panel for enclosing the front of said deck storage box;

a single-walled cover for enclosing the top of said deck storage box, said top cover constructed and arranged to provide ingress into and egress from said deck storage box;

a single-walled bottom panel for enclosing the bottom of said deck storage box, said bottom panel comprising a top surface, a bottom surface and four closed edges;

said bottom surface of said bottom panel is constructed and arranged to provide rigidity and stability to said deck storage box;

said top surface of said bottom panel having a means of attaching to said rear panel and said front panel, said means of attaching includes a plurality of locking sockets arranged in a linear fashion adjacent to the front and rear closed edges and extending downwardly from said top surface to secure said front and rear panels to said bottom panel and a plurality of grooves extending substantially around the perimeter of said top surface adjacent to said closed edges, wherein said plurality of grooves cooperate with the bottom edge of said left side panel, said right side panel, said rear panel and said front panel;

wherein said right panel includes a bottom edge having an outwardly extending tongue constructed and arranged to cooperate with said groove in said bottom panel, a first end having an attachment means constructed and arranged to cooperate with a rear panel in a perpendicular relationship, a second end having an attachment means constructed and arranged to cooperate with a front panel in a perpendicular relationship;

wherein said deck storage box can be shipped in a disassembled state and assembled on a desired site.

5. The deck storage box kit of claim 4 wherein said first end attachment means includes at least one integrally formed elongated contoured interlock post and said second end attachment means includes at least one integrally formed elongated contoured interlock post;

wherein said first elongated contoured interlock post is brought into an overlapping relationship with a corresponding elongated contoured interlock socket in said rear panel and said second elongated contoured interlock post is brought into an overlapping relationship with a corresponding elongated interlock socket in said front panel resulting in a mechanically secure connection between said right, front and rear panels.

6. A deck storage box kit comprising:

a single-walled left side panel for enclosing the left side of said deck storage box;

a single-walled right side panel for enclosing the right side of said deck storage box;

a single-walled rear panel for enclosing the back of said deck storage box;

a single-walled front panel for enclosing the front of said deck storage box;

a single-walled cover for enclosing the top of said deck storage box, said top cover constructed and arranged to provide ingress into and egress from said deck storage box;

a single-walled bottom panel for enclosing the bottom of said deck storage box, said bottom panel comprising a top surface, a bottom surface and four closed edges;

said bottom surface of said bottom panel is constructed and arranged to provide rigidity and stability to said deck storage box;

said top surface of said bottom panel having a means of attaching to said rear panel and said front panel, said means of attaching includes a plurality of locking sockets arranged in a linear fashion adjacent to the front and rear closed edges and extending downwardly from said top surface to secure said front and rear panels to said bottom panel and a plurality of grooves extending substantially around the perimeter of said top surface adjacent to said closed edges, wherein said plurality of grooves cooperate with the bottom edge of said left side panel, said right side panel, said rear panel and said front panel;

wherein said rear panel includes a bottom edge having at least one attachment means constructed and arranged to cooperate with said bottom panel in a perpendicular relationship, a top edge having an attachment means constructed and arranged to cooperate with said cover panel in a pivotable relationship, a first end having an attachment means constructed and arranged to cooperate with a left panel in a perpendicular relationship, and a second end having an attachment means constructed and arranged to cooperate with a right panel in a perpendicular relationship;

wherein said deck storage box can be shipped in a disassembled state and assembled on a desired site.

7. The deck storage box kit of claim 6 wherein said bottom edge attachment means includes at least one locking post extending downwardly from said bottom surface, said at least one locking post constructed and arranged to enter and mateably engage said bottom panel locking sockets securing said panels together in an inter-fitting engagement.

8. The deck storage box kit of claim 7 wherein said bottom edge attachment means further includes at least one outwardly extending tongue constructed and arranged to cooperate with said groove in said bottom panel to increase the structural integrity of said deck box by inhibiting said panels from bowing or bending inwardly or outwardly.

9. The deck storage box kit of claim 6 wherein said first end attachment means includes at least one integrally formed elongated contoured interlock socket and said second end attachment means includes at least one integrally formed elongated contoured interlock socket;

wherein said first elongated contoured interlock socket is brought into an overlapping relationship with a corresponding elongated contoured interlock post on said left panel and said second elongated contoured interlock socket is brought into an overlapping relationship with a corresponding elongated interlock post on said right panel resulting in a mechanically secure connection between said right, left and rear panels.

10. The deck storage box kit of claim 6 wherein said top edge attachment means includes at least one hinge pin receiver constructed and arranged for receiving a cover panel hinge pin;

wherein said hinge pin receiver allows said cover to be installed and removed when said cover is in an open position and said cover is secure and non-removable when in a closed position.

11. The deck storage box kit of claim 10 wherein said cover includes;

a top surface;

a bottom surface constructed and arranged to cooperate with said front panel, said rear panel, said left panel, and said right panel;

a front edge having a latch means constructed and arranged for releasably securing said cover to said front panel;

a rear edge having an hinge means constructed and arranged for pivotable securement of said cover to said rear panel;

a left closed edge; and a right closed edge.

12. The deck storage box kit of claim 11 wherein said hinge means includes at least one hinge pin secured to said rear edge by a pair of depending supports, said at least one hinge pin constructed and arranged to cooperate with said hinge pin receiver;

wherein said hinge pin receiver allows said cover to be installed and removed when said cover is in an open position and said cover is secure and non-removable when in a closed position.

13. The deck storage box kit of claim 11 wherein said latch means includes at least one catch plate depending from said bottom surface of said cover, said catch plate constructed and arranged to cooperate with said at least one spring-lock for releasably securing said cover.

14. The deck storage box kit of claim 11 wherein said top surface is configured as a bench seat.

15. A deck storage box kit comprising:

a single-walled left side panel for enclosing the left side of said deck storage box;

a single-walled right side panel for enclosing the right side of said deck storage box;

a single-walled rear panel for enclosing the back of said deck storage box;

a single-walled front panel for enclosing the front of said deck storage box;

a single-walled cover for enclosing the top of said deck storage box, said top cover constructed and arranged to provide ingress into and egress from said deck storage box;

a single-walled bottom panel for enclosing the bottom of said deck storage box, said bottom panel comprising a top surface, a bottom surface and four closed edges;

said bottom surface of said bottom panel is constructed and arranged to provide rigidity and stability to said deck storage said top surface of said bottom panel having a means of attaching to said rear panel and said front panel, said means of attaching includes a plurality of locking sockets arranged in a linear fashion adjacent to the front and rear closed edges and extending downwardly from said top surface to secure said front and rear panels to said bottom panel and a plurality of grooves extending substantially around the perimeter of said top surface adjacent to said closed edges, wherein said plurality of grooves cooperate with the bottom edge of said left side panel, said right side panel, said rear panel and said front panel;

wherein said front panel includes a bottom edge having at least one attachment means constructed and arranged to cooperate with said bottom panel in a perpendicular relationship, a top edge having an attachment means constructed and arranged to cooperate with said cover panel in a securely releasable relationship, a first end having an attachment means constructed and arranged to cooperate with a left panel in a perpendicular relationship, and a second end having an attachment means constructed and arranged to cooperate with a right panel in a perpendicular relationship;

wherein said deck storage box can be shipped in a disassembled state and assembled on a desired site.

16. The deck storage box kit of claim 15 wherein said bottom edge attachment means includes at least one locking post extending downwardly from said bottom surface, said at least one locking post constructed and arranged to enter and mateably engage said bottom panel locking sockets securing said panels together in an inter-fitting engagement.

17. The deck storage box kit of claim 16 wherein said bottom edge attachment means further includes at least one outwardly extending tongue constructed and arranged to cooperate with said groove in said bottom panel to increase the structural integrity of said deck box by inhibiting said panels from bowing or bending inwardly or outwardly.

18. The deck storage box kit of claim 15 wherein said first end attachment means includes at least one integrally formed elongated contoured interlock socket and said second end attachment means includes at least one integrally formed elongated contoured interlock socket;

wherein said first elongated contoured interlock socket is brought into an overlapping relationship with a corresponding elongated contoured interlock post on said left panel and said second elongated contoured interlock socket is brought into an overlapping relationship with a corresponding elongated interlock post on said right panel resulting in a mechanically secure connection between said right, left and rear panels.

19. The deck storage box kit of claim 15 wherein said top edge attachment means includes at least one spring-lock for releasably securing said cover, said spring-lock constructed and arranged to cooperate with a catch plate depending from said cover.

* * * * *